US012503745B2

(12) United States Patent
Yoshida et al.

(10) Patent No.: US 12,503,745 B2
(45) Date of Patent: Dec. 23, 2025

(54) STEEL SHEET AND STEEL SHEET MANUFACTURING METHOD

(71) Applicant: NIPPON STEEL CORPORATION, Tokyo (JP)

(72) Inventors: Mitsuru Yoshida, Tokyo (JP); Tsuyoshi Yamazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 402 days.

(21) Appl. No.: 18/020,596

(22) PCT Filed: Aug. 5, 2021

(86) PCT No.: PCT/JP2021/029121
§ 371 (c)(1),
(2) Date: Feb. 9, 2023

(87) PCT Pub. No.: WO2022/070608
PCT Pub. Date: Apr. 7, 2022

(65) Prior Publication Data

US 2023/0295761 A1 Sep. 21, 2023

(30) Foreign Application Priority Data

Sep. 30, 2020 (JP) ..... 2020-164941

(51) Int. Cl.

| | |
|---|---|
| ***C21D 9/46*** | (2006.01) |
| ***B21C 47/02*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/40*** | (2006.01) |

(52) U.S. Cl.

CPC ..... *C21D 9/46* (2013.01); *B21C 47/02* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C23C 2/40* (2013.01); *C21D 2211/001* (2013.01); *C21D 2211/003* (2013.01); *C21D 2211/008* (2013.01); *C21D 2211/009* (2013.01)

(58) Field of Classification Search
None
See application file for complete search history.

(56) References Cited

U.S. PATENT DOCUMENTS

| | | | |
|---|---|---|---|
| 2008/0223491 | A1 | 9/2008 | Kimijima |
| 2009/0188589 | A1 | 7/2009 | Okitsu |
| 2015/0329950 | A1 | 11/2015 | Azuma et al. |
| 2015/0376730 | A1 | 12/2015 | Shuto et al. |
| 2016/0076124 | A1 | 3/2016 | Yamazaki et al. |
| 2021/0140005 | A1 | 5/2021 | Yoshida et al. |
| 2021/0269892 | A1 | 9/2021 | Kim et al. |

FOREIGN PATENT DOCUMENTS

| | | | |
|---|---|---|---|
| JP | 2008-255484 | A | 10/2008 |
| JP | 2009-84648 | A | 4/2009 |
| JP | 2014-205890 | A | 10/2014 |
| WO | WO 2014/132968 | A1 | 9/2014 |
| WO | WO 2014/188966 | A1 | 11/2014 |
| WO | WO 2019/009410 | A1 | 1/2019 |
| WO | WO 2020/022778 | A1 | 1/2020 |

OTHER PUBLICATIONS

Toshihiro Tsuchiyama, "Physical Meaning of Tempering Parameter and Its Application for Continuous Heating or Cooling Heat Treatment Process", Heat treatment, vol. 42, No. 3, pp. 163-168, 2002.

*Primary Examiner* — Anthony M Liang
(74) *Attorney, Agent, or Firm* — Birch, Stewart, Kolasch & Birch, LLP

(57) ABSTRACT

This steel sheet has a predetermined chemical composition, at a depth position of ¼ of a sheet thickness from a surface, an area fraction of $GAM_{0.5\text{-}1.7}$ is 50% or more and 100% or less, an area fraction of $GAM_{>1.7}$ is 0% or more and 20% or less, an area fraction of $GAM_{\leq 0.5}$ is 0% or more and less than 50%, an area fraction of residual austenite is 0% or more and less than 4%, a total area fraction of the residual austenite, fresh martensite, cementite and pearlite is 0% or more and 10% or less, an average grain size is 15.0 μm or less, an average dislocation density is $1.0\times10^{14}/m^2$ or more and $4.0\times10^{15}/m^2$ less, a total of pole densities of {211}<011> and {332}<113> in a thickness middle portion is 12.0 or less, and a tensile strength is 980 MPa or more.

8 Claims, No Drawings

STEEL SHEET AND STEEL SHEET MANUFACTURING METHOD

TECHNICAL FIELD

The present invention relates to a steel sheet and a steel sheet manufacturing method.

In more detail, the present invention relates to a steel sheet having exceptional workability that is suitable as a material for applications such as cars, home appliances, mechanical structures, and construction and a steel sheet manufacturing method.

Priority is claimed on Japanese Patent Application No. 2020-164941, filed on Sep. 30, 2020, the content of which is incorporated herein by reference.

BACKGROUND ART

For steel sheets that are provided as a material for structural members of transportation machines including cars or a variety of industrial machines, a variety of properties such as strength; workability, such as elongation or hole expansibility; low temperature toughness; and uniformity are demanded.

For example, steel sheets that are applied to car suspension components are required to have exceptional ductility, in particular, uniform elongation necessary for bulging workability, and hole expansibility since bulging or hole expansion are forming techniques that are often used for such steel sheets. Steel sheets that are used for the above-described members are required to have these material properties and a high strength in a high-dimensional and well-balanced manner.

In addition, after being mounted in cars as components, the steel sheets need to have a property that makes the steel sheets be not easily broken even when impacted by collision or the like (impact resistance). Particularly, in cold climates where the steel sheets are used at low temperatures, members are likely to embrittle, and thus there is a need for improving the low temperature toughness of the steel sheets in order to ensure the impact resistance of the components. That is, thin steel sheets that are used for components of the above-described members are required to have not only exceptional workability but also low temperature toughness as an extremely important property for ensuring the impact resistance. The low temperature toughness is a property that is specified by vTrs (Charpy fracture appearance transition temperature) or the like.

As a steel sheet from which exceptional ductility can be obtained, a Dual Phase steel sheet (hereinafter, "DP steel") composed of a composite structure of soft ferrite and full hard martensite is known. However, DP steel has exceptional ductility, but is poor in terms of hole expansibility in some cases since voids are generated in the interface between ferrite and martensite, which have significantly different hardness, to cause cracking.

Patent Document 1 proposes a high strength hot rolled steel sheet having a tensile strength of 980 MPa or more and being exceptional in terms of shape fixability, hole expansibility and bendability, in which the area fractions of bainitic ferrite, martensite and bainite are each set to 90% or more, 5% or less, and 5% or less. However, in the invention described in Patent Document 1, there are cases where sufficient elongation cannot be obtained since bainitic ferrite is a main component.

Patent Document 2 proposes a high strength hot rolled steel sheet having a tensile strength of 980 MPa or more, in which 90% or more of bainite in terms of area fraction is included as a main phase, the remainder is composed of one or more structures selected from martensite, austenite and ferrite, and the amount and average grain diameter of cementite that is dispersed in the structure are controlled, thereby improving the hole expansibility. However, in the invention described in Patent Document 2, since the hot-rolled steel sheet is coiled at 330° C. to 470° C., which is a transition boiling region, there are cases where property unevenness is caused due to temperature unevenness in the sheet surface.

Patent Document 3 proposes a hot-rolled steel sheet having exceptional fatigue properties, in which the ferrite fraction is 50% to 95%, the fraction of a full-hard second phase consisting of martensite and residual austenite is 5% to 50%, the interrelationship between the amounts of carbide-forming elements or the relationship between the carbide-forming element and the C content is set to a predetermined range, and then the average grain diameter of precipitates and the fraction of the precipitates are specified. However, in the invention described in Patent Document 3, since soft ferrite is contained as the main component, and the strength is ensured by the precipitation hardening of a fine carbide, there are cases where sufficient low temperature toughness cannot be obtained.

Patent Document 4 proposes a hot-rolled steel sheet being exceptional in terms of bake hardenability and low temperature toughness and having a tensile strength of 980 MPa or more, in which the total of the volume fractions of any one or both of tempered martensite and lower bainite is 90% or more, and the average dislocation density in the tempered martensite and the lower bainite is specified. In addition, Patent Document 4 discloses that the low temperature toughness is further improved by setting the number density of an iron-based carbide in the tempered martensite and the lower bainite and the effective grain size and aspect ratio of the tempered martensite and the lower bainite to predetermined ranges. However, in Patent Document 4, hole expansibility that is considered to be necessary for the press-forming of suspension members is not taken into account.

CITATION LIST

Patent Document

[Patent Document 1]

Japanese Unexamined Patent Application, First Publication No. 2008-255484

[Patent Document 2]

Japanese Unexamined Patent Application, First Publication No. 2014-205890

[Patent Document 3]

Japanese Unexamined Patent Application, First Publication No. 2009-84648

[Patent Document 4]

PTC International Publication No. WO 2014/132968

Non Patent Document

[Non Patent Document 1]

Tsuchiyama, T (2002), 'Physical Meaning of Tempering Parameter and Its Application for Continuous Heating or Cooling Heat Treatment Process', Heat Treatment (3rd ed., Vol. 42) pp. 163-168

SUMMARY OF THE INVENTION

Problems to be Solved by the Invention

As described above, steel sheets having a high strength and being exceptional in terms of elongation, hole expansibility and low temperature toughness have not yet been proposed. The present invention has been made in consideration of the above-described problems, and an objective of the present invention is to provide a steel sheet having a high strength and being exceptional in terms of elongation (particularly, uniform elongation), hole expansibility and low temperature toughness and a manufacturing method thereof.

Means for Solving the Problem

The present inventors found that it is possible to manufacture a steel sheet having a high strength and being exceptional in terms of uniform elongation, hole expansibility and low temperature toughness by controlling the texture and microstructure of the steel sheet through the optimization of the chemical composition and manufacturing conditions of the steel sheet.

The gist of the present invention is as described below.

[1] A steel sheet according to one aspect of the present invention has a chemical composition containing, by mass %, C: 0.040% to 0.180%, Si: 0.005% to 2.00%, Mn: 1.00% to 3.00%, Ti: more than 0.200% and 0.400% or less, sol. Al: 0.001% to 1.000%, N: 0.0010% to 0.0100%, P: 0.100% or less, S: 0.0100% or less, Nb: 0% to 0.100%, V: 0% to 0.500%, Mo: 0% to 0.500%, Cu: 0% to 1.00%, Ni: 0% to 1.00%, Cr: 0% to 2.00%, B: 0% to 0.0030%, Ca: 0% to 0.0100%, Mg: 0% to 0.0100%, REM: 0% to 0.0100% and Bi: 0% to 0.0200% with a remainder of Fe and impurities, at a depth position of ¼ of a sheet thickness from a surface, an area fraction of $GAM_{0.5-1.7}$ that is crystal grains having a GAM of more than 0.5° and 1.7° or less is 50% or more and 100% or less, the GAM representing an average of crystal orientation differences in one crystal grain that are obtained by EBSD analysis, an area fraction of $GAM_{>1.7}$ that is crystal grains having the GAM of more than 1.7° is 0% or more and 20% or less, an area fraction of $GAM_{\leq 0.5}$ that is crystal grains having the GAM of 0.5° or less is 0% or more and less than 50%, an area fraction of residual austenite is 0% or more and less than 4%, a total area fraction of the residual austenite, fresh martensite, cementite and pearlite is 0% or more and 10% or less, an average grain size is 15.0 μm or less, an average dislocation density is $1.0\times10^{14}/m^2$ or more and $4.0\times10^{15}/m^2$ or less, a total of pole densities of {211}<011> and {332}<113> in a thickness middle portion is 12.0 or less, and a tensile strength is 980 MPa or more.

[2] The steel sheet according to [1], in which the chemical composition may contain, by mass %, one or more selected from the group consisting of Nb: 0.001% to 0.100%, V: 0.005% to 0.500%, Mo: 0.001% to 0.500%, Cu: 0.02% to 1.00%, Ni: 0.02% to 1.00%, Cr: 0.02% to 2.00%, B: 0.0001% to 0.0030%, Ca: 0.0002% to 0.0100%, Mg: 0.0002% to 0.0100%, REM: 0.0002% to 0.0100% and Bi: 0.0001% to 0.0200%.

[3] The steel sheet according to [1] or [2], in which a plating layer may be formed on the surface.

[4] The steel sheet according to [3], in which the plating layer may be a hot-dip galvanized layer.

[5] The steel sheet according to [3], in which the plating layer may be a hot-dip galvannealed layer.

[6] A steel sheet manufacturing method according to another aspect of the present invention is a manufacturing method of the steel sheet according to [1], having a heating step of heating a slab or steel piece having the chemical composition according to [1], a hot rolling step of performing multi-pass hot rolling on the slab or the steel piece after the heating step using a plurality of rolling stands to obtain a hot-rolled steel sheet, a coiling step of coiling the hot-rolled steel sheet and a heat treatment step of performing a heat treatment on the hot-rolled steel sheet after the coiling step, in which, in the heating step, a heating temperature is set to 1280° C. or higher and a temperature SRT (° C.) represented by the following formula (1) or higher, in the hot rolling step, when a finish temperature is represented by FT in a unit of ° C., a total rolling reduction in a temperature range of higher than FT+50° C. and FT+150° C. or lower is set to 50% or more, a total rolling reduction in a temperature range of FT to FT+50° C. is set to 40% to 80%, a time necessary for rolling in the temperature range of FT to FT+50° C. is set to 0.5 to 10.0 seconds, two or more passes of rolling are performed in each of the temperature range of higher than FT+50° C. and FT+150° C. or lower and the temperature range of FT to FT+50° C., an average cooling rate in a temperature range of FT to FT+100° C. is set to 6.0° C./sec or faster and 40.0° C./sec or slower, FT is set to equal to or higher than $Ar_3$ that is obtained from the following formula (2), equal to or higher than TR (° C.) that is obtained from the following formula (3) and 1100° C. or lower, water cooling is initiated within 3.0 seconds from completion of finish rolling, an average cooling rate in a temperature range of FT to 750° C. is set to 30° C./sec or faster, the slab or the steel piece is dwelt in a temperature range of 750° C. to 620° C. for 20 seconds or shorter and then cooled to a cooling stop temperature that is 620° C. to 570° C. such that an average cooling rate in a temperature range of the cooling stop temperature reaches 30° C./sec or faster, in the coiling step, the hot-rolled steel sheet is coiled at 570° C. or lower, in the heat treatment step, a maximum attainment temperature Tmax is set to 550° C. or higher and 720° C. or lower, and a tempering parameter Ps is set to 14000 to 18000.

$$SRT\ (^\circ C.)=1630+90\times\ln([C]\times[Ti]) \quad (1)$$

$$Ar_3\ (^\circ C.)=901-325\times[C]+33\times[Si]-92\times[Mn]+287\times[P]+40\times[sol.\ Al] \quad (2)$$

$$TR\ (^\circ C.)=800+700\times[Ti]+1000\times[Nb] \quad (3)$$

Here, [element symbol] in the formulae (1), (2) and (3) indicates the amount of each element by mass %, and zero is assigned in a case where the element is not contained.

[7] The steel sheet manufacturing method according to [6], in which, in the hot rolling step, the water cooling may be initiated within 0.3 seconds from completion of the finish rolling, and cooling in which an average cooling rate in a temperature range of FT to FT−40° C. is 100° C./sec or faster may be performed.

Effects of the Invention

According to the above-described aspects of the present invention, it is possible to provide a steel sheet having a high strength and being exceptional in terms of uniform elongation, hole expansibility and low temperature toughness and a manufacturing method thereof. The "steel sheet" of the present invention includes "plated steel sheet" having a plating layer on the surface.

When the steel sheet according to the present invention is used as a material of a car suspension component, it is easy to work the steel sheet into a component shape, and the steel sheet is capable of withstanding the use in an extremely cold climate, and thus industrial contribution is extremely significant.

EMBODIMENT FOR IMPLEMENTING THE INVENTION

Hereinafter, a steel sheet according to an aspect of the present invention (the steel sheet according to the present embodiment) and a steel sheet manufacturing method according to the present embodiment will be described in detail. First, the chemical composition of the steel sheet according to the present embodiment (in the case of a plated steel sheet, the chemical composition of a base steel sheet excluding a plating layer) will be described. However, the present invention is not limited only to a configuration disclosed in the present embodiment and can be modified in a variety of manners within the scope of the gist of the present invention.

Numerical limiting ranges to be expressed below using "to" include numerical values at both ends in the ranges as the lower limit and the upper limit. However, in the case of being expressed as "less than" or "more than", values are not included in the numerical ranges. In the following description, "%" regarding the chemical composition of steel indicates "mass %" in all cases.

Chemical Composition (C: 0.040% to 0.180%)

C is an effective element for the formation of a low temperature transformation phase such as martensite or bainite that contributes to improvement in strength. In addition, C is also an element that bonds to Ti or the like to form a carbide, thereby increasing the strength of steel. When the C content is less than 0.040%, it is difficult to obtain a tensile strength of 980 MPa or more. Therefore, the C content is set to 0.040% or more. The C content is preferably 0.060% or more.

On the other hand, when the C content is more than 0.180%, the weldability deteriorates. Therefore, the C content is set to 0.180% or less. The C content is preferably 0.170% or less, more preferably 0.160% or less, and still more preferably 0.140% or less.

(Si: 0.005% to 2.00%)

Si is an element having an action of increasing the strength of steel by solid solution strengthening and the enhancement of hardenability. In addition, Si is also an element having an action of suppressing the precipitation of cementite. When the Si content is less than 0.005%, it becomes difficult to exhibit the above-described actions. Therefore, the Si content is set to 0.005% or more. The Si content is preferably 0.01% or more, more preferably 0.03% or more, still more preferably 0.05% or more and far still more preferably 0.10% or more.

On the other hand, when the Si content is more than 2.00%, the surface properties of the steel sheet significantly deteriorate due to surface oxidation in a hot rolling step. Therefore, the Si content is set to 2.00% or less. The Si content is preferably 1.50% or less and more preferably 1.30% or less.

(Mn: 1.00% to 3.00%)

Mn is an element having an action of increasing the strength of steel by solid solution strengthening and the enhancement of hardenability. When the amount of Mn is less than 1.00%, it becomes difficult to obtain a tensile strength of the steel sheet of 980 MPa or more. Therefore, the Mn content is set to 1.00% or more. The Mn content is preferably 1.20% or more.

On the other hand, when the Mn content becomes excessive, the plastic anisotropy increases, and the hole expansibility deteriorates in some cases. The reason therefor is not clear, but is assumed to result from the precipitation of a large amount of MnS attributed to a large amount of Mn contained and recrystallization during hot rolling attributed to Mn segregation or a local unevenness in ferritic transformation after finish rolling. Therefore, the Mn content is set to 3.00% or less. The Mn content is preferably 2.80% or less, more preferably 2.60% or less, and still more preferably 2.40% or less.

(Ti: More than 0.200% and 0.400% or Less)

Ti is an element that bonds to C to forms a Ti-based carbide and contributes to improvement in the tensile strength of the steel sheet. In addition, Ti is also an element having an action of refining the metallographic structure by forming a Ti nitride that suppresses the coarsening of austenite during the heating of slabs and during hot rolling. When the Ti content is 0.200% or less, it becomes difficult to obtain desired properties due to an insufficient amount of precipitation hardening. Therefore, the Ti content is set to more than 0.200%. The Ti content is preferably 0.210% or more, more preferably 0.215% or more, and still more preferably 0.220% or more.

On the other hand, when the Ti content becomes excessive, a coarse Ti-based carbide remaining in austenite in a non-solid solution state promotes the formation of voids that are initiated from Ti-based inclusions in a non-solid solution state during working and degrades the uniform elongation. Therefore, the Ti content is set to 0.400% or less. The Ti content is preferably 0.350% or less and more preferably 0.300% or less.

The Ti-based carbide refers to a carbide having a NaCl-type crystal structure containing Ti. Carbides containing a small amount of a different carbide-forming alloy element, for example, Mo, Nb, V, Cr or W within the range of the chemical composition specified by the present embodiment can also be regarded as the Ti-based carbide as long as the carbides contain Ti. In addition, carbonitrides in which some of carbon is substituted by nitrogen are also regarded as the Ti-based carbide.

(Sol. Al: 0.001% to 1.000%)

Al is an element having an action of cleaning steel by deoxidation in a steelmaking stage (suppressing the initiation of a defect such as a blowhole in steel) and promoting ferritic transformation. When the sol. Al content is less than 0.001%, it becomes difficult to exhibit the above-described action. Therefore, the sol. Al content is set to 0.001% or more. The sot. Al content is preferably 0.010% or more and more preferably 0.020% or more.

Incidentally, even when the sol. Al content is set to more than 1.000%, the effect of the above-described action is saturated, and the refining cost increases. Therefore, the sol. Al content is set to 1.000% or less. The sol. Al content is preferably 0.800% or less and more preferably 0.600% or less. "Sol. Al" means acid-soluble Al.

(N: 0.0010% to 0.0100%)

N is an element having an action of refining the microstructure by forming a Ti nitride that suppresses the coarsening of austenite during the heating of slabs and during hot rolling. When the N content is less than 0.0010%, it becomes difficult to exhibit the above-described action. Therefore, the N content is set to 0.0010% or more. The N content is preferably 0.0015% or more and more preferably 0.0020% or more.

On the other hand, when the N content is more than 0.0100%, a coarse Ti nitride is formed to degrade the hole expansibility of the steel sheet. Therefore, the N content is set to 0.0100% or less. The N content is preferably 0.0060% or less and more preferably 0.0050% or less.

(P: 0.100% or Less)

P is an element that is contained in steel as an impurity and is an element that degrades the hole expansibility or low temperature toughness of the steel sheet. Therefore, the P content is set to 0.100% or less. The P content is preferably 0.060% or less, more preferably 0.040% or less and still more preferably 0.020% or less. P is incorporated from a raw material as an impurity, and the lower limit thereof does not need to be particularly limited, but the P content is preferably as small as possible to ensure the hole expansibility or the low temperature toughness. However, when the P content is excessively decreased, the manufacturing cost increases. From the viewpoint of the manufacturing cost, the P content is preferably 0.001% or more and more preferably 0.005% or more.

(S: 0.0100% or Less)

S is an element that is contained as an impurity and is an element that degrades the workability of the steel sheet. Therefore, the S content is set to 0.0100% or less.

The S content is preferably 0.0080% or less, more preferably 0.0060% or less and still more preferably 0.0030% or less. S is incorporated from the raw material as an impurity, and the lower limit thereof does not need to be particularly limited, but the S content is preferably as small as possible from the viewpoint of ensuring the workability. However, when the S content is excessively decreased, the manufacturing cost increases. From the viewpoint of the manufacturing cost, the S content is preferably 0.0001% or more, more preferably 0.0005% or more and still more preferably 0.0010% or more.

The remainder of the chemical composition of the steel sheet according to the present embodiment may be Fe and impurities. In the present embodiment, the impurity means an element that is allowed as long as the steel sheet according to the present embodiment is not adversely affected.

Incidentally, the steel sheet according to the present embodiment may contain, instead of some of Fe, one or more of the following optional elements (Nb, V, Mo, Cu, Ni, Cr, B, Ca, Mg, REM and Bi). That is, the chemical composition may contain the above-described elements and the optional elements to be described below, and the remainder may be Fe and impurities. Since the steel sheet according to the present embodiment is capable of achieving the objective even when not containing the optional elements, the lower limit of the amount of the optional elements is 0%.

(Nb: 0% to 0.100%)

Nb is an optional element. Nb is an element having effects of suppressing the coarsening of the grain sizes of the steel sheet, refining ferrite grain diameters, and increasing the strength of the steel sheet by the precipitation hardening of NbC. In the case of reliably obtaining these effects, the Nb content is preferably set to 0.001% or more. The Nb content is more preferably 0.005% or more.

On the other hand, when the Nb content is more than 0.100%, the above-described effects are saturated, and there are cases where the rolling force during finish rolling is increased. Therefore, in a case where Nb is contained, the Nb content is set to 0.100% or less. The Nb content is preferably 0.070% or less and more preferably 0.050% or less.

(V: 0% to 0.500%)

V is an optional element. V is an element having effects of increasing the strength of the steel sheet by forming a solid solution in steel and also improving the strength of the steel sheet through precipitation hardening by being precipitated in steel as a carbide, a nitride, a carbonitride, or the like. In the case of reliably obtaining these effects, the V content is preferably set to 0.005% or more. The V content is more preferably 0.010% or more.

On the other hand, when the V content exceeds 0.500%, there are cases where the toughness of the steel sheet deteriorates. Therefore, in a case where V is contained, the V content is set to 0.500% or less. The V content is preferably 0.300% or less.

(Mo: 0% to 0.500%)

Mo is an optional element. Mo is an element having effects of increasing the hardenability of steel and achieving the high-strengthening of the steel sheet by forming a carbide or a carbonitride. In the case of reliably obtaining these effects, the Mo content is preferably set to 0.001% or more. The Mo content is more preferably 0.005% or more.

On the other hand, when the Mo content exceeds 0.500%, there are cases where the cracking susceptibility of slabs is enhanced. Therefore, in a case where Mo is contained, the Mo content is set to 0.500% or less. The Mo content is preferably 0.300% or less.

(Cu: 0% to 1.00%)

Cu is an optional element. Cu is an element having an effect of improving the toughness of steel and an effect of increasing the strength. In the case of reliably obtaining these effects, the Cu content is preferably set to 0.02% or more. The Cu content is more preferably 0.08% or more.

On the other hand, when Cu is excessively contained, there are cases where the weldability of the steel sheet deteriorates. Therefore, in a case where Cu is contained, the Cu content is set to 1.00% or less. The Cu content is preferably 0.50% or less and more preferably 0.30% or less.

(Ni: 0% to 1.00%)

Ni is an optional element. Ni is an element having an effect of improving the toughness of steel and an effect of increasing the strength. In the case of reliably obtaining these effects, the Ni content is preferably set to 0.02% or more. The Ni content is more preferably 0.10% or more.

On the other hand, when Ni is excessively contained, not only does the alloying cost increase, but there are also cases where the toughness of a welded heat-affected zone in the steel sheet deteriorates. Therefore, in a case where Ni is contained, the Ni content is set to 1.00% or less. The Ni content is preferably 0.50% or less and more preferably 0.30% or less.

(Cr: 0% to 2.00%)

Cr is an optional element. Cr is an element having an effect of promoting the formation of fresh martensite or the like by enhancing the hardenability of steel. In the case of reliably obtaining this effect, the Cr content is preferably set to 0.02% or more. The Cr content is more preferably 0.05% or more.

On the other hand, when the Cr content becomes excessive, ferritic transformation in a cooling process after hot rolling is excessively delayed, and there are cases where it becomes difficult to obtain a desired amount of ferrite. Therefore, in a case where Cr is contained, the Cr content is set to 2.00% or less. The Cr content is preferably 1.50% or less, more preferably 1.00% or less and still more preferably 0.50% or less.

(B: 0% to 0.0030%)

B is an optional element. B is an element having an action of improving the peeling resistance by increasing the grain boundary strength through segregation at grain boundaries. In the case of obtaining this effect, the B content is preferably set to 0.0001% or more. The B content is more preferably 0.0002% or more.

Incidentally, even when the B content exceeds 0.0030%, the above-described effect is saturated. In addition, the alloying cost also increases. Therefore, in a case where B is contained, the B content is set to 0.0030% or less. The B content is preferably 0.0025% or less and more preferably 0.0020% or less.

(Ca: 0% to 0.0100%)

Ca is an optional element. Ca is an element having an effect of refining the metallographic structure of the steel sheet by dispersing a number of fine oxides in molten steel. In addition, Ca is an element having an effect of improving the hole expansibility of the steel sheet by fixing S in molten steel as spherical CaS to suppress the formation of an elongated inclusion such as MnS. In the case of reliably obtaining these effects, the Ca content is preferably set to 0.0002% or more. The Ca content is more preferably 0.0005% or more.

On the other hand, when the Ca content exceeds 0.0100%, CaO in steel increases, and there are cases where the toughness of the steel sheet deteriorates. Therefore, in a case where Ca is contained, the Ca content is set to 0.0100% or less. The Ca content is preferably 0.0050% or less and more preferably 0.0030% or less.

(Mg: 0% to 0.0100%)

Mg is an optional element. Similar to Ca, Mg is an element having effects of suppressing the formation of coarse MnS by forming an oxide or a sulfide in molten steel and refining the structure of the steel sheet by dispersing a number of fine oxides. In the case of reliably obtaining these effects, the Mg content is preferably set to 0.0002% or more. The Mg content is more preferably 0.0005% or more.

On the other hand, when the Mg content exceeds 0.0100%, an oxide in steel increases, and the toughness of the steel sheet deteriorates. Therefore, in a case where Mg is contained, the Mg content is set to 0.0100% or less. The Mg content is preferably 0.0050% or less and more preferably 0.0030% or less.

(REM: 0% to 0.0100%)

REM is an optional element. Similar to Ca, REM is an element having effects of suppressing the formation of coarse MnS by forming an oxide or a sulfide in molten steel and refining the structure of the steel sheet by dispersing a number of fine oxides. In the case of obtaining these effects, the REM content is preferably set to 0.0002% or more. The REM content is more preferably 0.0005% or more.

On the other hand, when the REM content exceeds 0.0100%, an oxide in steel increases, and there are cases where the toughness of the steel sheet deteriorates. Therefore, in a case where REM is contained, the REM content is set to 0.0100% or less. The REM content is preferably 0.0050% or less and more preferably 0.0030% or less.

Here, REM (rare earth metal) refers to a total of 17 elements consisting of Sc, Y and lanthanoids. In the present embodiment, the amount of REM refers to the total amount of these elements.

(Bi: 0% to 0.0200%)

Bi is an optional element. Bi is an element having an effect of improving the formability of the steel sheet by refining the solidification structure. In order to reliably obtain this effect, the Bi content is preferably set to 0.0001% or more. The Bi content is more preferably 0.0005% or more.

On the other hand, when the Bi content exceeds 0.0200%, the above-described effect is saturated, and the alloying cost increases. Therefore, in a case where Bi is contained, the 13 content is set to 0.0200% or less. The Bi content is preferably 0.0100% or less and more preferably 0.0070% or less.

The above-described chemical composition of the steel sheet may be measured by an ordinary analytical method. For example, the chemical composition may be measured using inductively coupled plasma-atomic emission spectrometry (ICP-AES). C and S may be measured using an infrared absorption method after combustion, and N may be measured using an inert gas fusion thermal conductivity method. In a case where a plating layer is provided on the surface, the chemical composition may be analyzed after the plating layer on the surface is removed by mechanical grinding.

Next, the metallographic structure (microstructure) of the steel sheet will be described. In the steel sheet according to the present embodiment, in a case where the average value of the average orientation differences in one crystal grain that can be obtained by electron backscattering diffraction (EBSD) analysis, which is often used for crystal orientation analysis, is defined as the grain average misorientation (GAM), there is a need to control the area fraction of crystal grains having a predetermined GAM at a depth position of ¼ of the sheet thickness from the surface. Specifically, the area fraction of crystal grains having a GAM of more than 0.5° and 1.7° or less ($GAM_{0.5\text{-}1.7}$) is 50% or more and 100% or less, the area fraction of crystal grains having a GAM of more than 1.7° ($GAM_{>}1.7$) is 0% or more and 20% or less, and the area fraction of crystal grains having a GAM of 0.5° or less ($GAM_{\leq 0.5}$) is 0% or more and less than 50%.

In addition, in the steel sheet according to the present embodiment, in the metallographic structure at the depth position of ¼ of the sheet thickness from the surface, the area fraction of residual austenite is 0% or more and less than 4%, the total area fraction of residual austenite, fresh martensite, cementite and pearlite is 0% or more and 10% or less, the average grain size is 15.0 μm or less, and the average dislocation density is $1.0\times10^{14}/m^2$ or more and $4.0\times10^{15}/m^2$ or less.

In addition, in the steel sheet according to the present embodiment, the total of pole densities of {211}<011> and {332}<113> in the thickness middle portion is 12.0 or less.

Hereinafter, each requirement will be described in detail.

In the steel sheet according to the present embodiment, at the depth position of ¼ of the sheet thickness from the surface of the steel sheet, $GAM_{0.5\text{-}1.7}$, $GAM_{>1.7}$, $GAM_{\leq 0.5}$, the area fraction of residual austenite, the total area fraction of "residual austenite, fresh martensite, cementite and pearlite", the average grain size and the average dislocation density are controlled to be in predetermined ranges. Here, the reason for specifying the steel structure at the depth position of ¼ of the sheet thickness from the surface of the steel sheet is that this depth position is the middle point between the surface of the steel sheet and the sheet thickness middle position and the steel structure at the position represents the steel structure of the steel sheet (indicates the average steel structure of the overall steel sheet) except for the texture. In the present embodiment, the depth position of ¼ of the sheet thickness from the surface of the steel sheet means a roughly ±100 μm range in the sheet thickness direction from, as the center, the depth position of ¼ of the sheet thickness in the sheet thickness direction from the surface of the steel sheet.

The present inventors found that a structure having dislocations or strain to an appropriate extent is exceptional in terms of the balance among strength, uniform elongation and low temperature toughness and found that such a structure can be defined by GAM that are obtained by EBSD analysis.

In the present embodiment, $GAM_{\leq 0.5}$ is ferrite, and $GAM_{>1.7}$ and $GAM_{0.5\text{-}1.7}$ are microstructures having a bcc crystal structure other than ferrite, that is, one or more of bainite, fresh martensite, tempered bainite, tempered martensite and pearlite.

(Area Fraction of $GAM_{0.5\text{-}1.7}$: 50% or More and 100% or Less)

The GAM is the average value of local crystal orientation differences in one crystal grain and is considered to have a correlation with the dislocation density or the amount of elastic strain in the crystal grain. Ordinarily, an increase in the dislocation density or elastic strain in a grain leads to improvement in strength, but degrades workability. In a crystal grain where the GAM has been controlled to more than 0.5° and 1.7° or less, it is possible to improve the strength without degrading the workability. Therefore, in the steel sheet according to the present embodiment, the area fraction of $GAM_{0.5\text{-}1.7}$ is controlled to 50% or more. The area fraction of $GAM_{0.5\text{-}1.7}$ is preferably 60% or more and more preferably 70% or more and may be 100%.

(Area Fraction of $GAM_{>1.7}$ being 0% or More and 20% or Less)

A crystal grain where the GAM is more than 1.7° ($GAM_{>1.7}$) has a high dislocation density and elastic strain, and the strength increases, but the ductility is poor. Therefore, the area fraction of $GAM_{>1.7}$ is controlled to 20% or less. The area fraction of $GAM_{>1.7}$ is preferably 10% or less and more preferably 5% or less and may be 0%.

(Area Fraction of $GAM_{\leq 0.5}$: 0% or More and Less than 50%)

A crystal grain where the GAM is 0.5° or less ($GAM_{\leq 0.5}$) has a low dislocation density and elastic strain and is thus effective for improving the balance between strength and uniform elongation. Therefore, such a crystal grain may be contained. On the other hand, when the area fraction of $GAM_{\leq 0.5}$ becomes 50% or more, it becomes difficult to obtain a desired strength. Therefore, the area fraction of $GAM_{\leq 0.5}$ is set to less than 50%. The area fraction of $GAM_{\leq 0.5}$ is preferably less than 40%. Since the steel sheet according to the present embodiment is capable of achieving the objective even when $GAM_{\leq 0.5}$ is not contained, the area fraction of $GAM_{\leq 0.5}$ may be 0%.

(Area Fraction of Residual Austenite: 0% or More and Less than 4%)

(Total Area Fraction of Residual Austenite, Fresh Martensite, Cementite and Pearlite: 0% or More and 10% or Less)

Residual austenite, fresh martensite, cementite and pearlite act as crack initiation points and degrade the hole expansibility or low temperature toughness of the steel sheet. Therefore, the total area fraction of residual austenite, fresh martensite, cementite and pearlite is set to 10% or less. The total area fraction is preferably 8% or less and more preferably 5% or less. Since the steel sheet according to the present embodiment is capable of achieving the objective even when these metallographic structures are not contained, the total area fraction of these metallographic structures may be 0%.

In addition, among these metallographic structures, residual austenite transforms into extremely full-hard fresh martensite by preliminary working such as punching and thereby significantly degrades the hole expansibility of the steel sheet. Therefore, the area fraction of residual austenite is set to less than 4%. The area fraction of residual austenite is preferably 3% or less, more preferably 2% or less, still more preferably less than 2% and far still more preferably 1% or less. Since the area fraction of residual austenite is preferably as small as possible, the area fraction may be 0%.

In addition, in the steel sheet according to the present embodiment, fresh martensite is present as a martensite-austenite constituent (MA).

(Average Grain Size: 15.0 μm or Less)

In the metallographic structure, when the average grain size is coarse, the fracture surface unit during rupture becomes large, and the low temperature toughness of the steel sheet deteriorates. Therefore, the average grain size is set to 15.0 μm or less. The average grain size is preferably 12.0 μm or less, more preferably 10.0 μm or less, and still more preferably 7.0 μm or less. The average grain size is preferably as small as possible, and thus the lower limit is not particularly limited. However, it is technically difficult to refine grains by normal hot rolling such that the average grain size becomes smaller than 1.0 μm. Therefore, the average grain size may be set to 1.0 μm or more or 4.0 μm or more.

The average grain size in the present embodiment refers to the average value of grain sizes in a case where a region that is surrounded by grain boundaries having a crystal orientation difference of 15° or more and has a circle equivalent diameter of 0.3 μm or more in the metallographic structure having a bcc crystal structure, that is, ferrite, bainite, fresh martensite, tempered bainite, tempered martensite and pearlite is defined as a crystal grain, and the grain sizes of residual austenite and cementite are not included in the calculation of the average grain size.

In the present embodiment, the average grain size and the area fraction of each structure are obtained by observing and measuring a structure at the depth position of ¼ of the sheet thickness from the surface of the steel sheet on a cross section of the steel sheet parallel to a rolling direction and the sheet thickness direction.

The average grain size, $GAM_{0.5\text{-}1.7}$, $GAM_{>1.7}$, $GAM_{\leq 0.5}$ and the area fraction of residual austenite are obtained by scanning electron microscope (SEM) observation and EBSD analysis using an EBSD analyzer made up of a thermal electric field radiation scanning electron microscope and an EBSD detector. Specifically, in a region that is 200 μm long in the rolling direction and 100 μm long in the sheet thickness direction, in which the depth position of ¼ of the sheet thickness from the surface of the steel sheet is centered, crystal orientation information is obtained at 0.2 μm intervals while differentiating fcc and bcc. Using the accompanying software ("OIM Analysis (registered trademark) manufactured by AMETEK Inc.") of the EBSD analyzer, boundaries where the crystal orientation difference is 15° or more are regarded as crystal grain boundaries, a region that is surrounded by crystal grain boundaries having a crystal orientation difference of 15° or more and has a circle equivalent diameter of 0.3 μm or more is defined as a crystal grain, and the average grain size of bcc is obtained by a method in which the following mathematical expression is used. In the mathematical expression, D represents the average grain size, N represents the number of crystal grains that are included in the evaluation region of the average grain size, Ai represents the area of an $i^{th}$ (i=1, 2, . . . , N) crystal grain, and di represents the circle equivalent diameter of the $i^{th}$ crystal grain.

$$D = \frac{\sum_{i=1}^{N} Ai \times di}{\sum_{i=1}^{N} Ai} \quad \text{[Math. 1]}$$

Crystal grain boundaries having a crystal orientation difference of 15° or more are mainly ferrite grain boundaries or the block boundaries of low temperature transformation phases, that is, bainite, fresh martensite, tempered bainite and tempered martensite. In a method for measuring the ferrite grain diameters according to JIS G 0552:2013, there are cases where a grain diameter is computed even for a ferrite grain having a crystal orientation difference of less than 15°, and, furthermore, the block of the low temperature transformation phase is not computed. Therefore, as the average grain size in the present embodiment, a value obtained by EBSD analysis as described above is adopted.

The area fraction of residual austenite is obtained by calculating the area fraction of a metallographic structure determined as fcc by EBSD analysis.

As the area fraction of $GAM_{0.5\text{-}1.7}$, $GAM_{>1.7}$ or $GAM_{\leq 0.5}$, regions that are surrounded by boundaries having a crystal orientation difference of 5° or more and having a circle equivalent diameter of 0.3 μm or more are defined as crystal grains, and the area fraction of crystal grains having a GAM value in each range, which is a value obtained by grain average misorientation analysis equipped in OIM Analysis (GAM value), in bcc crystal grains among crystal grains is calculated. The reason for defining a boundary having a crystal orientation difference of 5° or more as a crystal grain boundary is that there are cases where it is not possible to differentiate different structures formed as variants close to the same prior austenite grain if not so.

The area fractions of pearlite and cementite are obtained by observing metallographic structures revealed by Nital etching by SEM observation.

The area fraction of fresh martensite is obtained by obtaining the total area fraction of fresh martensite and residual austenite by observing the martensite-austenite constituent (MA) revealed by LePera corrosion with an optical microscope and subtracting the area fraction of residual austenite obtained by the above-described method from this total area fraction.

The area fractions of pearlite, cementite and MA may be obtained by image analysis or may be obtained by a point calculation method. For example, for pearlite and cementite, the area fractions may be obtained by observing three or more visual fields (100 μm×100 μm/visual field) at a depth position of ¼ of the sheet thickness from the surface of the steel sheet at a magnification of 1000 times and calculating the area fraction by the point calculation method with lattice spacings of 5 μm. In addition, the total area fraction of MA may be obtained by observing two or more visual fields (200 μm×200 μm/visual field) in a region at a ¼ depth position of the sheet thickness from the surface of the steel sheet at a magnification of 500 times and calculating the area fraction by the point calculation method at lattice spacings of 5 μm.

(Average Dislocation Density: $1.0\times10^{14}/m^2$ to $4.0\times10^{15}/m^2$)

In the steel sheet according to the present embodiment, the average dislocation density in the steel sheet structure at the depth position of ¼ of the sheet thickness from the surface is set to $4.0\times10^{15}/m^2$ or less. This is because desired uniform elongation is obtained. The average dislocation density is preferably $3.5\times10^{15}/m^2$ or less and more preferably $3.0\times10^{15}/m^2$ or less.

On the other hand, when the average dislocation density is less than $1.0\times10^{14}/m^2$, it is difficult to ensure the strength. Therefore, the average dislocation density is set to $1.0\times10^{14}/m^2$ or more. The average dislocation density is preferably $1.5\times10^{14}/m^2$ or more and more preferably $2.0\times10^{14}/m^2$ or more.

Regarding the average dislocation density, the half value widths of the diffraction peaks of (110), (211) and (220) at the depth position of ¼ of the sheet thickness from the surface of the steel sheet were each obtained using the X-ray diffraction method, and strain c is obtained by the Williamson-Hall method. The average dislocation density is obtained from $\rho=(14.4\varepsilon^2)/b^2$ based on the obtained strain ε and the Burgers vector b of iron (b=0.25 nm).

The steel sheet according to the present embodiment specifies the total of the pole densities of {211}<011> and {332}<113> at the thickness middle portion of the steel sheet. The thickness middle portion in the present embodiment refers to a range of approximately 200 μm in each of the front direction and the rear direction of the steel sheet from the middle position in the sheet thickness direction of the steel sheet (the depth position of ½ of the sheet thickness from the surface of the steel sheet).

The reason for specifying the texture at the thickness middle portion is that the texture at the thickness middle portion and mechanical properties favorably correlate with each other. The reason is not clear, but the present inventors assume as described below. In the steel sheet, due to friction between a roll and the steel sheet during rolling, shear deformation occurs in opposite directions in the front and rear of the steel sheet, and plane strain deformation occurs in the thickness middle portion. Since the texture of the steel sheet changes in the sheet thickness direction in response to this deformation, and, since the directions of the shear deformation are opposite to each other in the front and rear of the steel sheet, symmetric orientations develop in the front and rear in the texture. Therefore, the influences of the texture on mechanical properties are offset in the front and rear, and, consequently, the texture at the thickness middle portion and the mechanical properties favorably correspond to each other.

(Total of Pole Densities of {211}<011> and {332}<113> at Thickness Middle Portion: 12.0 or Less)

Due to the development of {211}<011> and {332}<113>, plastic anisotropy increases, and the hole expansibility of the steel sheet significantly deteriorates. Therefore, the total of the pole densities of {211}<011> and {332}<113> is set to 12.0 or less. The total of the pole densities of {211}<011> and {332}<113> is preferably 10.0 or less, more preferably 7.0 or less, even more preferably 6.0 or less and most preferably 5.0 or less. The total of the pole densities is preferably as small as possible; however, since the pole density of each orientation group is 1.0 in a case where the steel sheet does not include any texture, the total of the pole densities is more preferably set to a value close to 2.0.

The pole density can be obtained from crystal orientation information by the EBSD method and is a synonym of the X-ray random intensity ratio.

{hkl} indicates a crystal plane parallel to a rolled surface and <uvw> indicates a crystal orientation parallel to the rolling direction. That is, {hkl}<uvw> indicates a crystal in which {hkl} is oriented in the sheet surface normal line direction and <uvw> is oriented in the rolling direction.

In addition, in the present embodiment, the pole density of each crystal orientation in the thickness middle portion is obtained by measuring the orientation information of 1,000 or more bcc crystal grains while differentiating fcc and bcc at the thickness middle portion (a range of 200 μm in each of the front direction and the rear direction of the steel sheet from the thickness middle position (the depth position of ½ of the sheet thickness from the surface of the steel sheet)) by EBSD analysis using a device in which a scanning electron microscope and an EBSD analyzer are combined and OIM Analysis (registered trademark) manufactured by AMETEK Inc. and performing ODF analysis in which the harmonic series expansion is used.

Mechanical Properties (Tensile Strength: 980 MPa or More)

The steel sheet according to the present embodiment has a high strength and is exceptional in terms of low temperature toughness, elongation, and hole expansibility by the control of the chemical composition, the metallographic structure and the texture. However, when the tensile strength of the steel sheet is low, an effect of vehicle body weight reduction, stiffness improvement, or the like is weak. Therefore, the tensile strength (TS) of the steel sheet according to the present embodiment is set to 980 MPa or more. The tensile strength is preferably 1100 MPa or more and more preferably 1180 MPa or more. The upper limit is not particularly specified, but press forming becomes more difficult as the strength increases. Therefore, the tensile strength may be set to 1800 MPa or less, 1600 MPa or less, or 1400 MPa or less.

The steel sheet according to the present embodiment may have a plating layer on the surface (one or both). The plating layer improves the corrosion resistance. The plating type is not particularly limited and is ordinarily zinc-based plating including zinc plating and zinc alloy plating. As examples of the plated steel sheet, an electrolytic zinc-plated steel sheet, an electrolytic zinc-nickel alloy-plate steel sheet, a hot-dip galvanized steel sheet, a galvannealed steel sheet, a hot-dip zinc-aluminum alloy-plated steel sheet, and the like are exemplary examples. The plating adhesion amount may be an ordinary amount.

In the steel sheet according to the present embodiment, TS×El, which is an index of the balance between tensile strength (TS) and uniform elongation (uEl), is preferably 6000 MPa·% or more, more preferably 7000 MPa·% or more and still more preferably 8000 MPa·% or more.

The elongation of the steel sheet is evaluated using a No. 5 test piece of JIS Z 2241: 2011 by the percentage plastic extension at maximum force specified in JIS Z 2241: 2011, that is, uniform elongation (uEl).

In the steel sheet according to the present embodiment, TS×λ, which is an index of the balance between tensile strength and hole expansibility, is preferably 40000 MPa·% or more and more preferably 50000 MPa·% or more.

The hole expansibility of the steel sheet is evaluated by the limiting hole expansion ratio (λ) specified in JIS Z 2256: 2010.

In addition, in the steel sheet according to the present embodiment, the fracture appearance transition temperature (vTrs) in the Charpy impact test as an index of low temperature toughness is preferably −40° C. or lower.

The Charpy impact test is performed according to JIS Z 2242: 2005.

Manufacturing Method

A steel sheet manufacturing method according to the present embodiment is not particularly limited, and the steel sheet can be obtained by a manufacturing method including the following steps.

(I) A heating step of heating a slab or steel piece having a predetermined chemical composition.

(II) A hot rolling step of performing multi-pass hot rolling on the slab or the steel piece after the heating step using a plurality of rolling stands to obtain a hot-rolled steel sheet.

(III) A coiling step of coiling the hot-rolled steel sheet.

(IV) A heat treatment step of performing a heat treatment on the hot-rolled steel sheet after the coiling step.

Hereinafter, preferable conditions for each step will be described.

Heating Step (Heating Temperature: 1280° C. or Higher and SRT (° C.) or Higher)

The heating temperature of a slab or steel piece that is to be subjected to hot rolling is set to 1280° C. or higher and a temperature SRT (° C.) represented by the following formula (1) or higher. When the heating temperature is lower than 1280° C. or lower than SRT (° C.), the solutionizing of Ti carbonitride becomes insufficient, and the tensile strength or uniform elongation of the steel sheet deteriorates. Therefore, the slab or steel piece that is to be subjected to hot rolling is heated such that the temperature reaches 1280° C. or higher and SRT (° C.) or higher. Here, "the temperature of the slab or steel piece is 1280° C. or higher and SRT (° C.) or higher" means that the temperature of the slab or steel piece is equal to or higher than the higher temperature of 1280° C. and SRT (° C.). The heating temperature is preferably higher than 1300° C. and more preferably 1305° C. or higher.

On the other hand, when the heating temperature is higher than 1400° C., there are cases where a thick scale is formed to decrease the yield or significant damage is caused in the heating furnaces. Therefore, the heating temperature is preferably 1400° C. or lower.

$$\text{SRT}\ (^\circ\ \text{C.}) = 1630 + 90 \times \ln([C] \times [Ti]) \quad (1)$$

Here, [element symbol] in the formula (1) indicates the amount of each element by mass %.

The slab or steel piece that is to be heated may be a slab or steel piece obtained by continuous casting or casting and blooming or may also be a slab or steel piece obtained by additionally performing hot working or cold working on the above-described slab or steel piece.

Hot Rolling Step

In the hot rolling step, multi-pass hot rolling is performed on a slab or steel piece having the above-described chemical composition using a plurality of rolling stands, thereby manufacturing a hot-rolled steel sheet. The multi-pass hot rolling can be performed using a reverse mill or a tandem mill, and, from the viewpoint of industrial productivity, a tandem mill is preferably used in at least several stages from the end.

In the steel sheet manufacturing method according to the present embodiment, the finish temperature FT and the total rolling reduction, the time necessary for rolling, the number of passes and the cooling conditions in each temperature range based on the finish temperature FT in the hot rolling step are as described below.

Normally, these conditions are not all strictly controlled, but the present inventors found that, when these are controlled at the same time and, furthermore, post steps are also controlled, it is possible to obtain the steel sheet according to the present embodiment having a high strength and being exceptional in terms of elongation, hole expansibility and low temperature toughness.

(Total Rolling Reduction in Temperature Range of Higher than FT+50° C. and FT+150° C. or Lower: 50% or More)

In the steel sheet manufacturing method according to the present embodiment, when the finish temperature is represented by FT in the unit of ° C., recrystallized austenite grains in the steel sheet are refined by increasing the total rolling reduction of hot rolling in a temperature range of higher than FT+50° C. and FT+150° C. or lower. In order to refine the recrystallized austenite grains in the steel sheet, the total rolling reduction in the temperature range of higher than FT+50° C. and FT+150° C. or lower is set to 50% or more. When the total rolling reduction in the above-described temperature range is less than 50%, austenite is not sufficiently refined. In this case, metallographic structures after transformation become coarse, and recrystallization between rolling passes during rolling in a subsequent temperature range of FT to FT+50° C. is delayed, which makes the texture after transformation develop. The total rolling reduction in the temperature range of higher than FT+50° C. and FT+150° C. or lower is preferably as high as possible, but may be set to 90% or less since the industrial limit is approximately 90%.

(Total Rolling Reduction in Temperature Range of FT to FT+50° C.: 40% to 80%)

(Time Necessary for Rolling in Temperature Range of FT to FT+50° C.: 0.5 to 10.0 Seconds)

In the steel sheet manufacturing method according to the present embodiment, it is possible to obtain a steel sheet being exceptional in terms of workability and toughness by appropriately controlling the total rolling reduction in a temperature range of FT to FT+50° C. and the time necessary for rolling (rolling time) in association with the cooling conditions after hot rolling to be described below.

When the total rolling reduction in the temperature range of FT to FT+50° C. is less than 40%, the structures after transformation become coarse, recrystallization between the rolling passes and after rolling finish is delayed, and the amount of deformation of the inside of the steel sheet becomes uneven. In this case, a specific orientation develops after transformation, whereby the hole expansibility of the steel sheet deteriorates. Therefore, the total rolling reduction in the temperature range of FT to FT+50° C. is set to 40% or more. On the other hand, when the total rolling reduction in the above-described temperature range exceeds 80%, since the texture significantly develops even after recrystallization, the hole expansibility of the steel sheet deteriorates. Therefore, the total rolling reduction in the temperature range of FT to FT+50° C. is set to 80% or less.

In the steel sheet manufacturing method according to the present embodiment, furthermore, it is also important to appropriately control the time necessary for rolling in the above-described temperature range (the temperature range of FT to FT+50° C.). In a case where the time necessary for rolling in the above-described temperature range is too short, recrystallization does not proceed between the passes, rolling strain is excessively accumulated, and a specific orientation develops, which makes it difficult to obtain a desired texture. Therefore, the time necessary for rolling in the above-described temperature range is set to 0.5 seconds or longer. The time is preferably 1.0 second or longer and more preferably 2.0 seconds or longer. On the other hand, in a case where the time necessary for rolling in the above-described temperature range is too long, recrystallized grains grow between the rolling passes, and the structures after transformation become coarse. Therefore, the time necessary for rolling in the above-described temperature range is set to 10.0 seconds or shorter. The time is preferably 8.0 seconds or shorter, more preferably 6.0 seconds or shorter, and still more preferably 5.0 seconds or shorter.

(Two or More Passes of Rolling being Performed in Each of Temperature Range of Higher than FT+50° C. and FT+150° C. or Lower and Temperature Range of FT to FT+50° C.)

It is important to repeat working and recrystallization in both the rolling in the temperature range of higher than FT+50° C. and FT+150° C. or lower and the rolling in the temperature range of FT to FT+50° C. Therefore, two or more passes of rolling are performed in each of the temperature ranges.

The total rolling reduction in each temperature range in the hot rolling step refers to the percentage of the total rolling reduction in a predetermined temperature range with respect to the inlet sheet thickness before the initial pass in the temperature range (the difference between the inlet sheet thickness before the initial pass of rolling in this temperature range and the outlet sheet thickness after the final pass of rolling in this temperature range).

(Average Cooling Rate in Temperature Range of FT to FT+100° C.: 6.0° C./Sec or Faster and 40.0° C./Sec or Slower)

The temperature of the steel sheet during the hot rolling changes due to heat generation by deformation of rolling, removal of heat by contact with a roll, or the like; however, in the present embodiment, the average cooling rate in a temperature range of FT to FT+100° C. is appropriately controlled in order to control the precipitation of the Ti-based carbide and the texture. When the steel sheet is dwelt for a long period of time in a low temperature region close to the finish temperature, the Ti-based carbide is precipitated due to working, and the strength decreases. On the other hand, when the rolling is completed within a short period of time, the texture develops, and the hole expansibility deteriorates. Therefore, the average cooling rate in the temperature range of FT to FT+100° C. is set to 6.0° C./sec or faster and 40.0° C./sec or slower. The average cooling rate in this temperature range is preferably 9.0° C./sec or faster and 30.0° C./sec or slower and more preferably 12.0° C./sec or faster and 20.0° C./sec or slower.

The average cooling rate within the above-described temperature range is controlled by controlling heat generation due to deformation and the removal of heat by the contact between the steel sheet and a roll through the control of the rolling speed and the rolling reduction. Furthermore, the average cooling rate is controlled by performing water cooling, induction heating, or the like as necessary. In addition, the average cooling rate in the above-described temperature range is obtained by measuring the surface temperature of the steel sheet with a radiation-type thermometer or the like or by simulation in a case where the measurement is difficult.

(Finish Temperature FT (° C.): Equal to or Higher than $Ar_3$ (° C.) Obtained from Formula (2), Equal to or Higher than TR (° C.) Obtained from Formula (3), and 1100° C. or Lower)

$$Ar_3\ (°\ C.)=901-325\times[C]+33\times[Si]-92\times[Mn]+287\times[P]+40\times[sol.\ Al] \quad (2)$$

$$TR\ (°\ C.)=800+700\times[Ti]+1000\times[Nb] \quad (3)$$

Here, [element symbol] in formulae (2) and (3) indicates the amount of each element by mass %, and zero is assigned in a case where the element is not contained.

In the steel sheet manufacturing method according to the present embodiment, the working and recrystallization of austenite are repeated during finish rolling, thereby refining the metallographic structures and suppressing the development of the texture. Therefore, the finish temperature FT is set to equal to or higher than $Ar_3$ (° C.) that is obtained from the formula (2) and equal to or higher than TR (° C.) that is obtained from the formula (3). Here, the finish temperature FT refers to the surface temperature of the steel sheet immediately after final rolling.

When FT is lower than $Ar_3$ (° C.), ferritic transformation proceeds during finish rolling, the coarse Ti-based carbide is precipitated together with the ferritic transformation, and the strength of the steel sheet decreases. In addition, when the FT is lower than TR (° C.), austenite after the hot rolling and before cooling becomes significantly flat. In this case, in the steel sheet as a final product, the structure is elongated in the rolling direction, and the plastic anisotropy becomes large, which makes the hole expansibility of the steel sheet deteriorate. When FT is set to equal to or higher than TR (° C.), the recrystallization of worked austenite between the rolling passes is appropriately accelerated, which makes it possible to refine recrystallized austenite grains. After the hot rolling, it is possible to obtain a steel sheet having steel structures and a texture suitable for low temperature toughness and hole expansibility in association with the cooling conditions after the hot rolling to be described below.

On the other hand, when FT exceeds 1100° C., the structure becomes coarse, and the low temperature toughness of the steel sheet deteriorates. Therefore, FT is set to 1100° C. or lower. The FT is preferably 1080° C. or lower and more preferably 1060° C. or lower.

The temperature during the finish rolling refers to the surface temperature of a steel material and can be measured with a radiation-type thermometer or the like.

(Time from Completion of Finish Rolling to Initiation of Water Cooling: Within 3.0 Seconds)

After the completion of the finish rolling, water cooling is initiated within 3.0 seconds in order to refine the metallographic structure using strain accumulated by the rolling. This water cooling may be performed in a plurality of divided stages. When the time from the completion of the finish rolling to the initiation of the water cooling (the time elapsing after the completion of the finish rolling until the water cooling is initiated) is longer than 3.0 seconds, strain in austenite is recovered, which makes it difficult to obtain a desired structure. The time from the completion of the finish rolling to the initiation of the water cooling is preferably within 2.0 seconds, more preferably within 1.0 second and still more preferably within 0.5 seconds. The time from the completion of the finish rolling to the initiation of the water cooling is preferably 0.05 seconds or longer or 0.1 seconds or longer in order to recrystallize austenite after the completion of the finish rolling.

(Average Cooling Rate in Temperature Range of FT to 750° C.: 30° C./Sec or Faster)

The control of the average cooling rate from the temperature at which the finish rolling is completed (finish temperature: FT (° C.)) to 750° C. is important to obtain a desired metallographic structure. The average cooling rate is calculated from a temperature change of FT to 750° C. and the time taken for this temperature change, and this time includes the time taken from the completion of the finish rolling to the initiation of the water cooling. When the average cooling rate in the above-described temperature range is slower than 30° C./sec, the formation of a fine structure becomes difficult, and a coarse Ti-based carbide is precipitated at the same time with ferritic transformation in the cooling process, which degrades the strength of the steel sheet. Therefore, the average cooling rate in the above-described temperature range is set to 30° C./sec or faster. The average cooling rate is preferably 40° C./sec or faster and more preferably 50° C./sec or faster. The upper limit does not need to be particularly limited, but the average cooling rate is preferably 300° C./sec or slower, more preferably 200° C./sec or slower, still more preferably 150° C./sec or slower and far still more preferably 110° C./sec or slower from the viewpoint of suppressing sheet warpage attributed to thermal strain.

Rapid cooling in a high temperature range after the end of the finish rolling in the temperature range of FT to 750° C. enables the metallographic structure to be further refined and thus further improves the low temperature toughness of the steel sheet. In order for that, it is preferable to initiate the water cooling within 0.3 seconds from the completion of the finish rolling and set the average cooling rate from FT to FT−40° C. to 100° C./sec or faster in addition to setting the average cooling rate from the FT to 750° C. to 30° C./sec or faster. In this case, the rapid cooling does not hinder the water cooling to be performed in a step intended for rapid cooling in a temperature range of FT to FT−40° C. and a plurality of cooling steps for performing subsequent cooling. When the average cooling rate from FT to FT−40° C. is slower than 100° C./sec, it becomes difficult to obtain the above-described effect. The average cooling rate from FT to FT−40° C. is preferably 120° C./sec or faster and more preferably 150° C./sec or faster. Regarding the average cooling rate in this temperature range, the upper limit does not need to be particularly limited, but the average cooling rate is preferably 1000° C./sec or slower from the viewpoint of suppressing a temperature unevenness in the steel sheet.

The rapid cooling in the high temperature range after the end of the finish rolling (cooling from FT to FT−40° C.) may be performed not only after the final stand of the finish rolling but also between the rolling stands. That is, in a stand after the rapid cooling, rolling may not be performed or rolling may be performed with a rolling reduction of 8% or less for the purpose of shape correction, cooling control, or the like. In this case, the rolling after the rapid cooling is not regarded as rolling in a finish rolling step.

(Dwell Time at 750° C. to 620° C.: 20 Seconds or Shorter)

For the purpose of improving uniform elongation, ferrite, which is a structure where the GAM is 0.5° or less, may be precipitated. In order for that, a desired area fraction of $GAM_{\leq 0.5}$ may be obtained by adjusting the dwell time of the hot-rolled steel sheet after the finish rolling in a temperature range of 750° C. to 620° C., where ferritic transformation becomes active. When the dwell time in the above-described temperature range exceeds 20 seconds, ferrite is excessively precipitated or pearlite or cementite is excessively precipitated, which decreases the strength. Therefore, the dwell time in the above-described temperature range is preferably set to 20 seconds or shorter. The dwell time is preferably 17 seconds or shorter, more preferably 14 seconds or shorter and still more preferably 10 seconds or shorter. The lower limit may be set to one second in consideration of the installation capacity.

In the present embodiment, the dwell time at 750° C. to 620° C. refers to the time taken for the temperature of the steel sheet after the finish rolling to reach 750° C. and then decrease to reach 620° C., but the steel sheet does not necessarily need to be cooled in this range throughout this time.

(Average Cooling Rate in Temperature Range of 620° C. to Cooling Stop Temperature of 570° C. or Lower: 30° C./Sec or Faster)

In order to transform untransformed austenite to fresh martensite or bainite, the steel sheet is cooled to the cooling stop temperature set to 570° C. or lower such that the average cooling rate in a temperature range from 620° C. to the cooling stop temperature becomes 30° C./sec or faster. When the average cooling rate in the above-described temperature range is slower than 30° C./sec, cementite or pearlite is formed during cooling, which makes it difficult to obtain a desired metallographic structure. The average cooling rate in the above-described temperature range is preferably 40° C./sec or faster and more preferably 50° C./sec or faster. The upper limit of the average cooling rate in the above-described temperature range is not particularly limited, but is preferably 300° C./sec or slower, more preferably 200° C./sec or slower, still more preferably 150° C./sec or slower and far still more preferably 110° C./sec or slower from the viewpoint of suppressing sheet warpage attributed to thermal strain.

Coiling Step (Coiling Temperature: 570° C. or Lower)

After the cooling, the steel sheet is coiled at 570° C. or lower. In a case where the steel sheet has been coiled at higher than 570° C., there are cases where the Ti-based carbide is excessively precipitated at near the coiling temperature due to slow cooling after the coiling, which degrades the hole expansibility or the toughness. Therefore, the coiling temperature is set to 570° C. or lower. The coiling temperature is preferably 560° C. or lower and more preferably 550° C. or lower. From the viewpoint of suppressing the precipitation of the Ti-based carbide after the coiling, the coiling temperature may be 570° C. or lower, and the lower limit is not limited.

The coiling temperature and the cooling stop temperature become almost the same temperature in many cases.

Heat Treatment Step (Maximum Attainment Temperature Tmax: 550° C. to 720° C.)

In the heat treatment step, fresh martensite and bainite formed in the hot rolling step and the coiling step are tempered by a heat treatment, and the Ti-based carbide is precipitated while adjusting the dislocation density, thereby obtaining a steel sheet being exceptional in terms of strength, uniform elongation and toughness. When the maximum attainment temperature Tmax of the heat treatment step is lower than 550° C., there is a concern that the area fraction of $GAM_{>1.7}$ may become excessive due to a delayed decrease in elastic strain in the crystal grains. Therefore, Tmax is set to 550° C. or higher. Tmax is preferably 570° C. or higher and more preferably 600° C. or higher. On the other hand, when Tmax is higher than 720° C., the Ti-based carbide becomes coarse, which makes it difficult to obtain the strength. In addition, the formation of pearlite or coarse cementite degrades the hole expansibility or toughness of the steel sheet. Therefore, Tmax is set to 720° C. or lower. Tmax is preferably 700° C. or lower.

(Tempering Parameter Ps: 14000 to 18000)

In the heat treatment step, elastic strain and dislocations in the crystal grains decreases, and the Ti-based carbide is precipitated, whereby a steel sheet having an exceptional balance between strength and uniform elongation can be obtained. When the tempering parameter Ps is less than 14000, the decrease in elastic strain and dislocations becomes insufficient, and the effect of improving the balance between strength and uniform elongation cannot be obtained. Therefore, the Ps is set to 14000 or more. On the other hand, when the Ps is more than 18000, the Ti-based carbide becomes coarse, and the strength decreases or pearlite or coarse cementite is formed, which degrades the hole expansibility or the toughness. Therefore, the Ps is set to 18000 or less.

In a case where the heat treatment temperature is constant, the Ps can be obtained from Ps=(T+273)×(20+log(t)). In the formula, T represents the heat treatment temperature (° C.), and t represents the heat treatment time (hours). However, in a case where the heat treatment temperature is not constant, that is, in a case where the temperature changes continuously as in continuous annealing, it is possible to calculate the tempering parameter as an integrated tempering parameter by a method in which the heat treatment step is taken into account as described in Non Patent Document 1. In the present embodiment, the integrated tempering parameter calculated based on the method described in Non Patent Document 1 is used as the tempering parameter Ps.

The tempering parameter Ps is specifically obtained by the following method.

The time taken from the initiation of heating to the end of the heating is divided into a total number N of infinitely small units of time Δt. Here, the average temperature in an $(n-1)^{th}$ section is represented by $T_{n-1}$ (° C.), and the average temperature in an $n^{th}$ section is represented by $T_n$ (° C.). The tempering parameter P(1) corresponding to the initial infinitely small unit of time (a section in the case of n=1) can be obtained from the following formula. "log" indicates a common logarithm with base 10.

$$P(1)=(T_1+273)\times(20+\log(\Delta t))$$

P(1) can be expressed as a value equivalent to P that is calculated based on a temperature $T_2$ and a heating time $t_2$ from the following formula.

$$(T_1+273)\times(20+\log(\Delta t))=(T_2+273)\times(20+\log(t_2))$$

The time $t_2$ is a time taken (equivalent time) to obtain P equivalent to the integrated value of P that is calculated based on heating in the section before the second section (that is, the first section) at the temperature $T_2$. The heating time in the second section (temperature $T_2$) is a time obtained by adding the actual heating time Δt to the time $t_2$. Therefore, an integrated value P(2) of P at a point in time where the heating in the second section has been completed can be obtained from the following formula.

$$P(2)=(T_2+273)\times(20+\log(t_2+\Delta t))$$

When this formula is generalized, the following formula (4) is obtained.

$$P(n)=(T_n+273)\times(20+\log(t_n+\Delta t)) \quad (4)$$

The time $t_n$ is an equivalent time for obtaining P equivalent to the integrated value of P at a point in time where the heating in the $(n-1)^{th}$ section has been completed at a temperature $T_n$. The time $t_n$ can be calculated from the formula (5).

$$\log(t_n)=((T_{n-1}+273)/(T_n+273))\times(20+\log(t_{n-1}))-20 \quad (5)$$

The $N^{th}$ tempering parameter P(N), which can be obtained by the above-described method, is the integrated value of P at a point in time where heating in the $N^{th}$ section has been completed, and this is Ps.

In the present embodiment, the steel sheet may be made into a plated steel sheet by performing plating in the heat treatment step. Even in the case of performing plating after the heat treatment, the plating may be performed within the scope of the above-described heat treatment conditions by regarding the heat treatment step and the plating step as a continuous step. The plating may be any of electro plating or hot-dip plating. The plating type is also not particularly limited and is ordinarily zinc-based plating including zinc plating and zinc alloy plating. As examples of the plated steel sheet, an electrolytic zinc-plated steel sheet, an electrolytic zinc-nickel alloy-plate steel sheet, a hot-dip galvanized steel sheet, a galvannealed steel sheet, a hot-dip zinc-aluminum alloy-plated steel sheet, and the like are exemplary examples. The plating adhesion amount may be an ordinary amount. Before the plating, Ni or the like may be applied to the surface as pre-plating.

At the time of manufacturing the steel sheet according to the present embodiment, well-known temper rolling may be performed as appropriate for the purpose of shape correction.

The sheet thickness of the steel sheet according to the present embodiment is not particularly limited, but is preferably 6.0 mm or less since, in a case where the sheet thickness is too thick, structures that are formed in the surface layer and the inside of the steel sheet become significantly different. On the other hand, when the sheet thickness is too thin, since threading during the hot rolling becomes difficult, ordinarily, the sheet thickness is preferably 1.0 mm or more. The sheet thickness is more preferably 1.2 mm or more.

EXAMPLES

Next, the effects of one aspect of the present invention will be more specifically described using examples, but conditions in the examples are simply examples of the conditions adopted to confirm the feasibility and effect of the present invention, and the present invention is not limited to these examples of the conditions. The present invention is capable of adopting a variety of conditions within the scope of the gist of the present invention as long as the objective of the present invention is achieved.

Steels having a chemical composition shown in Table 1 were melted, cast and then made into 40 mm-thick steel pieces by hot forging. The obtained steel pieces were heated, hot rolled by performing a plurality of times (two to four passes) of rolling in a small tandem mill for testing having a plurality of rolling stands in both of a temperature range of higher than FT+50° C. and FT+150° C. or lower and a temperature range of FT to FT+50° C., thereby obtaining hot-rolled steel sheets having a sheet thickness of 2.5 to 3.5 mm. These hot-rolled steel sheets were cooled with water, coiled and then heat-treated, thereby obtaining steel sheets (hot-rolled steel sheets). Each manufacturing condition is shown in Table 2-1 and Table 2-2.

In the heat treatment, the time interval at the time of calculating the tempering parameter Ps was set to one second.

In addition, plating was performed on some of the steel sheets.

TABLE 1

| | Chemical composition (mass %), remainder: Fe and impurities | | | | | | | | | | | |
|---|---|---|---|---|---|---|---|---|---|---|---|---|
| Steel | C | Si | Mn | Ti | Sol. Al | N | P | S | Nb | V | Mo | Cu |
| A | 0.107 | 1.05 | 2.45 | 0.265 | 0.051 | 0.0038 | 0.009 | 0.0030 | | | | |
| B | 0.162 | 0.06 | 2.05 | 0.253 | 0.410 | 0.0017 | 0.015 | 0.0031 | | | | |
| C | 0.099 | 0.55 | 2.12 | 0.263 | 0.510 | 0.0040 | 0.011 | 0.0032 | | | | |
| D | 0.235 | 0.98 | 2.01 | 0.237 | 0.340 | 0.0029 | 0.013 | 0.0030 | | | | |
| E | 0.107 | 0.12 | 1.15 | 0.268 | 0.320 | 0.0020 | 0.008 | 0.0035 | | | | |
| F | 0.101 | 1.10 | 0.45 | 0.228 | 0.410 | 0.0035 | 0.009 | 0.0022 | | | | |
| G | 0.084 | 0.23 | 2.23 | 0.205 | 0.400 | 0.0031 | 0.016 | 0.0036 | | | | |
| H | 0.082 | 0.32 | 2.52 | 0.325 | 0.400 | 0.0031 | 0.016 | 0.0036 | | | | |
| I | 0.094 | 1.04 | 2.25 | 0.270 | 0.380 | 0.0023 | 0.010 | 0.0018 | 0.031 | | | |
| J | 0.090 | 0.92 | 2.24 | 0.253 | 0.320 | 0.0031 | 0.015 | 0.0044 | | 0.248 | | |
| K | 0.101 | 1.01 | 2.52 | 0.217 | 0.290 | 0.0025 | 0.014 | 0.0030 | | | 0.150 | |
| L | 0.101 | 0.96 | 2.04 | 0.228 | 0.360 | 0.0030 | 0.009 | 0.0038 | | | | 0.15 |
| M | 0.103 | 0.93 | 2.18 | 0.238 | 0.300 | 0.0036 | 0.012 | 0.0025 | | | | |
| N | 0.090 | 0.96 | 2.65 | 0.253 | 0.280 | 0.0035 | 0.009 | 0.0039 | | | | |
| O | 0.109 | 0.99 | 2.56 | 0.261 | 0.400 | 0.0042 | 0.018 | 0.0049 | | | | |
| P | 0.117 | 0.96 | 2.67 | 0.244 | 0.410 | 0.0030 | 0.011 | 0.0033 | | | | |
| Q | 0.145 | 1.18 | 3.78 | 0.213 | 0.040 | 0.0032 | 0.015 | 0.0025 | | | | |
| R | 0.105 | 1.06 | 1.67 | 0.236 | 0.390 | 0.0030 | 0.015 | 0.0031 | | | | |
| S | 0.109 | 0.99 | 1.87 | 0.425 | 0.380 | 0.0021 | 0.010 | 0.0039 | | | | |
| T | 0.105 | 1.42 | 2.41 | 0.236 | 0.019 | 0.0031 | 0.015 | 0.0031 | | | | |

| | Chemical composition (mass %), remainder: Fe and impurities | | | | | | | SRT | $Ar_3$ | TR |
|---|---|---|---|---|---|---|---|---|---|---|
| Steel | Ni | Cr | B | Ca | Mg | REM | Bi | (° C.) | (° C.) | (° C.) |
| A | | | | | | | | 1309 | 680 | 986 |
| B | | | | | | | | 1342 | 682 | 977 |
| C | | | | | | | | 1302 | 715 | 984 |
| D | | | | | | | | 1370 | 689 | 966 |
| E | | | | | | | | 1310 | 779 | 988 |

TABLE 1-continued

| | | | | | | | | | | |
|---|---|---|---|---|---|---|---|---|---|---|
| F | | | | | | | | 1291 | 882 | 960 |
| G | | | | | | | | 1264 | 697 | 944 |
| H | | | | | | | | 1304 | 674 | 1028 |
| I | | | | | | | | 1299 | 716 | 1020 |
| J | | | | | | | | 1290 | 713 | 977 |
| K | | 0.36 | | | | | | 1286 | 685 | 952 |
| L | 0.30 | | | | | | | 1291 | 729 | 960 |
| M | | | 0.0012 | | | | | 1296 | 713 | 967 |
| N | | | | 0.0018 | | | | 1290 | 673 | 977 |
| O | | | | | 0.0012 | | | 1310 | 684 | 983 |
| P | | | | | | 0.0015 | | 1310 | 669 | 971 |
| Q | | | | | | | | 1317 | 551 | 949 |
| R | | | | | | | 0.0012 | 1297 | 768 | 965 |
| S | | | | | | | | 1354 | 744 | 1098 |
| T | | | | | | | | 1297 | 694 | 965 |

Underlines indicate that corresponding values are outside the scope of the present invention.

TABLE 2-1

| | | | Hot rolling | | | | |
|---|---|---|---|---|---|---|---|
| Steel sheet No. | Steel | Heating Heating temperature (° C.) | Total rolling reduction in temperature range of higher than FT + 50° C. and FT + 150° C. or lower (%) | Total rolling reduction in temperature range of FT to FT + 50° C. (%) | Rolling time in temperature range of FT to FT + 50° C. (sec) | Average cooling rate in temperature range of FT to FT + 100° C. (° C./sec) | Finish temperature FT (° C.) |
| 1 | A | 1350 | 60 | 79 | 3.2 | 15.1 | 997 |
| 2 | A | 1351 | 62 | 66 | 2.2 | 17.8 | 1003 |
| 3 | A | 1349 | 58 | 48 | 2.3 | 16.4 | 1002 |
| 4 | A | 1246 | 61 | 73 | 2.0 | 15.8 | 997 |
| 5 | A | 1352 | 24 | 65 | 1.9 | 17.2 | 996 |
| 6 | A | 1354 | 54 | 85 | 3.2 | 15.1 | 998 |
| 7 | A | 1351 | 63 | 72 | 0.4 | 16.5 | 996 |
| 8 | A | 1352 | 65 | 67 | 3.5 | 1.4 | 1001 |
| 9 | A | 1351 | 62 | 66 | 2.2 | 41.2 | 1015 |
| 10 | A | 1354 | 82 | 65 | 1.7 | 16.3 | 852 |
| 11 | A | 1349 | 62 | 45 | 2.3 | 16.5 | 1004 |
| 12 | A | 1350 | 64 | 45 | 2.6 | 15.8 | 1000 |
| 13 | B | 1353 | 81 | 66 | 1.9 | 16.9 | 996 |
| 14 | C | 1346 | 82 | 66 | 2.2 | 15.0 | 1001 |
| 15 | D | 1384 | 71 | 70 | 2.0 | 15.1 | 983 |
| 16 | E | 1351 | 69 | 66 | 2.2 | 15.1 | 1006 |
| 17 | E | 1354 | 66 | 67 | 2.2 | 15.7 | 1002 |
| 18 | E | 1354 | 61 | 71 | 2.1 | 16.2 | 1007 |
| 19 | E | 1352 | 78 | 66 | 1.9 | 17.1 | 1001 |
| 20 | E | 1352 | 54 | 76 | 3.9 | 17.6 | 1006 |
| 21 | E | 1353 | 70 | 73 | 3.4 | 15.4 | 1007 |
| 22 | F | 1351 | 69 | 68 | 3.1 | 15.4 | 975 |
| 23 | G | 1306 | 78 | 66 | 1.9 | 17.1 | 1001 |
| 24 | H | 1347 | 66 | 66 | 2.2 | 16.8 | 1040 |
| 25 | I | 1343 | 69 | 66 | 1.8 | 17.8 | 1035 |
| 26 | J | 1345 | 66 | 65 | 1.7 | 16.7 | 994 |
| 27 | K | 1330 | 69 | 67 | 1.9 | 17.7 | 967 |
| 28 | L | 1330 | 79 | 66 | 2.1 | 15.1 | 972 |
| 29 | M | 1351 | 78 | 60 | 1.9 | 18.0 | 982 |
| 30 | N | 1354 | 67 | 66 | 2.1 | 16.7 | 995 |
| 31 | O | 1353 | 70 | 65 | 3.1 | 17.4 | 993 |
| 32 | P | 1352 | 68 | 62 | 2.4 | 17.3 | 989 |
| 33 | Q | 1340 | 65 | 64 | 3.6 | 15.5 | 967 |
| 34 | R | 1350 | 69 | 69 | 2.1 | 17.4 | 984 |
| 35 | S | 1382 | 68 | 70 | 1.8 | 15.5 | 974 |
| 36 | T | 1345 | 64 | 68 | 2.4 | 18.0 | 985 |

Underlines indicate that corresponding values are outside the scope of the present invention.

TABLE 2-2

| Steel. sheet No | Hot rolling: Time elapsing after finish rolling until water cooling initiation (sec) | Average cooling rate in temperature range of FT to FT - 40° C. (° C./sec) | Average cooling rate in temperature range of FT to 750° C. (° C./sec) | Dwell time at 750° C. to 620° C. (sec) | Average cooling rate from 620° C. to cooling step temperature of 570° C. or lower (° C./sec) | Coiling Coiling temperature (° C.) | Heat treatment: Maximum attainment temperature Tmax (° C.) | Tempering parameter Ps |
|---|---|---|---|---|---|---|---|---|
| 1 | 1.6 | 85 | 56 | 3 | 62 | 542 | 659 | 16228 |
| 2 | 0.1 | 165 | 56 | 2 | 61 | 506 | 611 | 15787 |
| 3 | 0.4 | 154 | 32 | 8 | 66 | 517 | 658 | 16294 |
| 4 | 0.3 | 106 | 96 | 2 | 62 | 533 | 640 | 16399 |
| 5 | 0.5 | 61 | 52 | 3 | 75 | 491 | 622 | 15992 |
| 6 | 0.4 | 69 | 41 | 4 | 69 | 466 | 634 | 16698 |
| 7 | 0.5 | 59 | 48 | 3 | 61 | 477 | 649 | 16873 |
| 8 | 1.1 | 37 | 40 | 5 | 62 | 515 | 628 | 16607 |
| 9 | 0.1 | 152 | 60 | 3 | 71 | 523 | 625 | 15865 |
| 10 | 1.4 | 54 | 38 | 2 | 85 | 530 | 633 | 16674 |
| 11 | 0.1 | 167 | 81 | 3 | 64 | 35 | 685 | 17957 |
| 12 | 0.2 | 158 | 80 | 3 | 75 | 35 | 485 | 17056 |
| 13 | 0.8 | 65 | 55 | 5 | 60 | 532 | 642 | 17265 |
| 14 | 0.4 | 77 | 53 | 2 | 74 | 480 | 639 | 15839 |
| 15 | 0.1 | 152 | 82 | 3 | 53 | 481 | 630 | 15886 |
| 16 | 0.1 | 195 | 57 | 4 | 70 | 521 | 630 | 16609 |
| 17 | 0.1 | 201 | 18 | 4 | 69 | 490 | 639 | 16644 |
| 18 | 0.1 | 178 | 83 | 35 | 70 | 510 | 675 | 16600 |
| 19 | 0.1 | 178 | 61 | 3 | 66 | 525 | 684 | 18958 |
| 20 | 0.1 | 154 | 49 | 3 | 66 | 472 | 415 | 12154 |
| 21 | 0.1 | 156 | 55 | 3 | 62 | 487 | 765 | 17856 |
| 22 | 0.1 | 178 | 56 | 3 | 68 | 497 | 639 | 16764 |
| 23 | 0.1 | 178 | 61 | 1 | 66 | 517 | 617 | 16372 |
| 24 | 0.1 | 172 | 48 | 1 | 78 | 508 | 656 | 16575 |
| 25 | 0.1 | 179 | 47 | 3 | 75 | 528 | 673 | 16645 |
| 26 | 0.1 | 195 | 61 | 1 | 60 | 538 | 636 | 15965 |
| 27 | 0.1 | 165 | 45 | 2 | 71 | 530 | 637 | 16672 |
| 28 | 0.2 | 154 | 54 | 1 | 93 | 488 | 634 | 15803 |
| 29 | 0.1 | 187 | 50 | 1 | 76 | 524 | 656 | 16963 |
| 30 | 0.2 | 162 | 74 | 3 | 77 | 480 | 674 | 16887 |
| 31 | 0.3 | 168 | 50 | 3 | 76 | 542 | 648 | 16658 |
| 32 | 0.2 | 155 | 49 | 3 | 81 | 465 | 617 | 15978 |
| 33 | 0.1 | 172 | 80 | 3 | 65 | 511 | 578 | 15310 |
| 34 | 0.1 | 156 | 48 | 2 | 92 | 498 | 676 | 16779 |
| 35 | 0.1 | 174 | 46 | 2 | 84 | 465 | 673 | 17066 |
| 36 | 0.1 | 155 | 60 | 3 | 71 | 512 | 625 | 15821 |

Underlines indicate that corresponding values are outside the scope of the present invention.

Regarding the obtained steel sheets, the area fractions of $GAM_{0.5-1.7}$, $GAM_{>1.7}$ and $GAM_{\leq 0.5}$, the area fraction of residual austenite (retained γ), the total area fraction of residual austenite, fresh martensite, cementite and pearlite, the average grain size, the average dislocation density of the metallographic structure at the depth position of ¼ of the sheet thickness from the surface of the steel sheet and the pole density of each crystal orientation in the thickness middle portion were obtained by the above-described methods. In the measurement of the pole density of the crystal orientation in the thickness middle portion, information of approximately 3000 bcc crystal orientations was measured.

In order to evaluate the mechanical properties of the obtained steel sheets, the tensile strength TS (MPa) and the uniform elongation uEl (%) were evaluated with a No. 5 test piece according to JIS Z 2241: 2011.

The hole expansibility was evaluated by the limiting hole expansion ratio λ (%) that was measured according to JIS Z 2256:2010.

The low temperature toughness was evaluated by the fracture appearance transition temperature vTrs (° C.) and evaluated by performing a Charpy impact test using a V-notch test piece obtained by working the steel sheet into a 2.5 mm sub-size test piece according to JIS Z 2242:2005.

Table 3-1 and Table 3-2 show the test results of the metallographic structures, the textures and the mechanical properties. In the 'plating' column of Table 3-2, "GI" indicates a hot-dip galvanized layer and "GA" indicates a hot-dip galvannealed layer. In addition, regarding the expression of the average dislocation density of Table 3-1, for example, 8.3E+14 indicates $8.3\times10^{14}$.

In the case of 980 MPa or more, the tensile strength was judged as a high strength, and when vTrs (° C.) was −40° C. or lower, the steel sheet was judged to be exceptional in terms of low temperature toughness. The workability was evaluated by the balance between strength and uniform elongation (TS×uEl) and the balance between strength and hole expansibility (TS×λ). In a case where TS×uEl (MPa·%) was 6000 MPa·% or more, the strength was judged to be high, and the uniform elongation was judged as "exceptional." In a case where TS×λ. (MPa·%) was 50000 MPa·% or more, the strength was judged to be high, and the hole expansibility was judged as "exceptional."

TABLE 3-1

| Steel sheet No. | Steel | Area fraction of $GAM_{0.5-1.7}$ (%) | Area fraction of $GAM_{>1.7}$ (%) | Area fraction of $GAM_{\leq 0.5}$ (%) | Area fraction of retained γ (%) | Total area fraction of retained γ, pearlite, fresh martensite and cementite (%) | Average grain size (μm) | Average dislocation density ($/m^2$) |
|---|---|---|---|---|---|---|---|---|
| 1 | A | 95 | 2 | 3 | 0 | 1 | 7.5 | 8.3E+14 |
| 2 | A | 88 | 5 | 7 | 0 | 1 | 6.4 | 1.1E+15 |
| 3 | A | 66 | 4 | 30 | 0 | 0 | 8.6 | 5.9E+14 |
| 4 | A | 92 | 6 | 2 | 0 | 1 | 7.0 | 8.8E+14 |
| 5 | A | 84 | 3 | 13 | 0 | 1 | 15.4 | 8.6E+14 |
| 6 | A | 71 | 5 | 24 | 0 | 1 | 7.9 | 7.6E+14 |
| 7 | A | 87 | 3 | 10 | 0 | 0 | 7.2 | 7.2E+14 |
| 8 | A | 61 | 4 | 35 | 0 | 0 | 8.4 | 7.3E+14 |
| 9 | A | 82 | 3 | 15 | 0 | 2 | 6.5 | 1.4E+15 |
| 10 | A | 63 | 2 | 35 | 0 | 0 | 3.7 | 6.7E+14 |
| 11 | A | 95 | 5 | 0 | 0 | 2 | 7.9 | 3.6E+15 |
| 12 | A | 73 | 26 | 0 | 1 | 1 | 7.0 | 3.3E+15 |
| 13 | B | 74 | 10 | 15 | 1 | 5 | 5.4 | 2.2E+15 |
| 14 | C | 86 | 6 | 8 | 0 | 2 | 5.0 | 7.4E+14 |
| 15 | D | 77 | 13 | 10 | 0 | 12 | 5.0 | 2.7E+15 |
| 16 | E | 79 | 5 | 16 | 0 | 1 | 5.0 | 1.0E+15 |
| 17 | E | 42 | 2 | 56 | 0 | 0 | 5.4 | 3.0E+14 |
| 18 | E | 10 | 3 | 87 | 0 | 2 | 7.0 | 7.8E+13 |
| 19 | E | 85 | 4 | 11 | 0 | 0 | 4.1 | 9.0E+14 |
| 20 | E | 56 | 24 | 20 | 0 | 0 | 7.4 | 5.3E+15 |
| 21 | E | 78 | 6 | 16 | 0 | 2 | 5.3 | 1.2E+14 |
| 22 | F | 50 | 5 | 45 | 0 | 0 | 5.1 | 4.6E+14 |
| 23 | G | 93 | 3 | 4 | 0 | 0 | 4.0 | 9.0E+14 |
| 24 | H | 89 | 5 | 6 | 0 | 0 | 6.2 | 6.7E+14 |
| 25 | I | 87 | 0 | 13 | 0 | 0 | 5.3 | 4.6E+14 |
| 26 | J | 92 | 3 | 5 | 0 | 0 | 5.3 | 5.5E+14 |
| 27 | K | 87 | 1 | 12 | 0 | 0 | 5.0 | 8.3E+14 |
| 28 | L | 87 | 5 | 8 | 0 | 1 | 4.1 | 4.7E+14 |
| 29 | M | 92 | 1 | 7 | 0 | 0 | 4.2 | 5.9E+14 |
| 30 | N | 87 | 3 | 10 | 0 | 1 | 5.8 | 8.7E+14 |
| 31 | O | 83 | 2 | 15 | 0 | 0 | 5.6 | 9.6E+14 |
| 32 | P | 84 | 4 | 12 | 0 | 2 | 5.9 | 9.0E+14 |
| 33 | Q | 79 | 15 | 1 | 5 | 8 | 6.0 | 8.6E+14 |
| 34 | R | 84 | 3 | 13 | 0 | 0 | 5.2 | 7.6E+14 |
| 35 | S | 85 | 1 | 14 | 0 | 0 | 4.9 | 9.7E+14 |
| 36 | T | 85 | 5 | 10 | 0 | 0 | 6.7 | 1.1E+15 |

Underlines indicate that corresponding values are outside the scope of the present invention.

TABLE 3-2

| Steel sheet No. | Pole density total of {211}<011> and {332}<113> | TS (MPa) | uEl (%) | TS × uEl (MPa · %) | λ (%) | TS × λ (MPa · %) | vTrs (° C.) | Plating | Remark |
|---|---|---|---|---|---|---|---|---|---|
| 1 | 6.1 | 1246 | 8.0 | 9959 | 62 | 77307 | −51 | GI | Invention Example |
| 2 | 3.2 | 1255 | 7.7 | 9608 | 80 | 100055 | −57 | GI | Invention Example |
| 3 | 3.8 | 1238 | 8.4 | 10382 | 76 | 94415 | −47 | None | Invention Example |
| 4 | 5.8 | 845 | 6.2 | 5239 | 64 | 54133 | −54 | GI | Comparative Example |
| 5 | 11.5 | 1247 | 8.0 | 9920 | 33 | 41143 | −9 | GA | Comparative Example |
| 6 | 12.8 | 1244 | 8.1 | 10062 | 20 | 24877 | −49 | GA | Comparative Example |
| 7 | 12.3 | 1243 | 8.2 | 10130 | 23 | 28735 | −56 | GA | Comparative Example |
| 8 | 3.4 | 968 | 8.1 | 7881 | 78 | 75980 | −48 | GA | Comparative Example |
| 9 | 12.6 | 1258 | 6.2 | 9608 | 20 | 25160 | −55 | GI | Comparative Example |
| 10 | 13.6 | 1241 | 8.2 | 10233 | 15 | 18612 | −76 | GI | Comparative Example |
| 11 | 3.5 | 1325 | 6.3 | 8404 | 78 | 103550 | −46 | GI | Invention Example |
| 12 | 3.6 | 1368 | 4.2 | 5746 | 65 | 88920 | −50 | GI | Comparative Example |
| 13 | 5.9 | 1161 | 6.9 | 7993 | 50 | 58030 | −42 | GA | Invention Example |
| 14 | 5.0 | 1188 | 8.1 | 9662 | 69 | 81373 | −63 | GA | Invention Example |
| 15 | 1.8 | 1206 | 6.6 | 8001 | 64 | 76847 | −25 | GI | Comparative Example |
| 16 | 4.5 | 1179 | 7.8 | 9156 | 72 | 84987 | −65 | GA | Invention Example |
| 17 | 4.4 | 965 | 9.1 | 8823 | 73 | 70132 | −66 | GA | Comparative Example |
| 18 | 3.4 | 925 | 10.7 | 9892 | 79 | 72842 | −51 | GA | Comparative Example |
| 19 | 4.7 | 970 | 7.9 | 7674 | 55 | 53350 | −28 | GA | Comparative Example |
| 20 | 6.3 | 1282 | 4.2 | 5383 | 61 | 78078 | −55 | None | Comparative Example |
| 21 | 6.0 | 924 | 6.6 | 6098 | 42 | 38808 | −26 | GA | Comparative Example |

TABLE 3-2-continued

| Steel sheet No. | Pole density total of {211}<011> and {332}<113> | TS (MPa) | uEl (%) | TS × uEl (MPa · %) | λ (%) | TS × λ (MPa · %) | vTrs (° C.) | Plating | Remark |
|---|---|---|---|---|---|---|---|---|---|
| 22 | 6.4 | 975 | 8.7 | 8463 | 60 | 58800 | −68 | GA | Comparative Example |
| 23 | 4.7 | 1161 | 7.9 | 9180 | 70 | 81609 | −74 | GA | Invention Example |
| 24 | 4.5 | 1156 | 8.2 | 9520 | 72 | 83152 | −61 | GA | Invention Example |
| 25 | 4.5 | 1009 | 8.7 | 8743 | 72 | 72587 | −67 | GA | Invention Example |
| 26 | 5.0 | 1309 | 8.5 | 11078 | 69 | 90326 | −67 | GA | Invention Example |
| 27 | 6.6 | 1257 | 8.0 | 10043 | 59 | 73512 | −69 | GA | Invention Example |
| 28 | 6.6 | 1363 | 8.6 | 11774 | 59 | 80170 | −71 | GA | Invention Example |
| 29 | 5.9 | 1120 | 8.4 | 9394 | 63 | 70960 | −73 | GI | Invention Example |
| 30 | 6.3 | 1151 | 7.9 | 9136 | 61 | 69895 | −61 | GA | Invention Example |
| 31 | 5.8 | 1174 | 7.8 | 9193 | 64 | 74630 | −65 | GI | Invention Example |
| 32 | 5.9 | 1211 | 7.9 | 9571 | 63 | 76580 | −57 | GI | Invention Example |
| 33 | 6.1 | 1624 | 8.0 | 12916 | 10 | 16242 | −15 | GA | Comparative Example |
| 34 | 6.4 | 1228 | 8.1 | 9941 | 60 | 73798 | −68 | GA | Invention Example |
| 35 | 12.3 | 1176 | 4.5 | 5292 | 23 | 27195 | −69 | GA | Comparative Example |
| 36 | 5.2 | 1220 | 7.6 | 9272 | 65 | 79300 | −55 | GI | Invention Example |

Underlines indicate that corresponding values are outside the scope of the present invention.

According to Table 3-1 and Table 3-2, it is found that the steel sheets Nos. 1 to 3, 11, 13, 14, 16, 23 to 32, 34 and 36, which were the invention examples, had a high strength and were exceptional in terms of low temperature toughness, uniform elongation and hole expansibility. On the other hand, it is found that the steel sheets Nos. 4 to 10, 12, 15, 17 to 22, 33 and 35, which were the comparative examples, were poor in terms of any one or more of the properties.

INDUSTRIAL APPLICABILITY

According to the above-described aspect according to the present invention, it is possible to provide a steel sheet having a high strength and being exceptional in terms of elongation, hole expansibility and low temperature toughness and a manufacturing method thereof. When the steel sheet according to the present invention is used as a material of a component for an inner plate member, a structural member, a suspension member, or the like of a car, it is easy to work the steel sheet into a component shape, and the steel sheet is capable of withstanding the use in an extremely cold climate, and thus industrial contribution is extremely significant.

What is claimed is:

1. A steel sheet having a chemical composition comprising, by mass %:

C: 0.040% to 0.180%;
Si: 0.005% to 2.00%;
Mn: 1.00% to 3.00%;
Ti: more than 0.200% and 0.400% or less;
sol. Al: 0.001% to 1.000%;
N: 0.0010% to 0.0100%;
P: 0.100% or less;
S: 0.0100% or less;
Nb: 0% to 0.100%;
V: 0% to 0.500%;
Mo: 0% to 0.500%;
Cu: 0% to 1.00%;
Ni: 0% to 1.00%;
Cr: 0% to 2.00%;
B: 0% to 0.0030%;
Ca: 0% to 0.0100%;
Mg: 0% to 0.0100%;
REM: 0% to 0.0100%; and
Bi: 0% to 0.0200%, with a remainder of Fe and impurities, wherein a total of pole densities of {211}<011> and {332}<113> in a thickness middle portion is 12.0 or less, and a tensile strength is 980 MPa or more, and wherein, at a depth position of ¼ of a sheet thickness from a surface, an area fraction of $GAM_{0.5\text{-}1.7}$ that is crystal grains having a GAM of more than 0.5° and 1.7° or less is 50% or more and 100% or less, the GAM representing an average of crystal orientation differences in one crystal grain that are obtained by EBSD analysis, an area fraction of $GAM_{>1.7}$ that is crystal grains having the GAM of more than 1.7° is 0% or more and 20% or less, an area fraction of $GAM_{<0.5}$ that is crystal grains having the GAM of 0.5° or less is 0% or more and less than 50%, an area fraction of residual austenite is 0% or more and less than 4%, a total area fraction of the residual austenite, fresh martensite, cementite and pearlite is 0% or more and 10% or less, an average grain size is 15.0 μm or less, and an average dislocation density is $1.0\times10^{14}/m^2$ or more and $4.0\times10^{15}/m^2$ or less.

2. The steel sheet according to claim 1, wherein the chemical composition contains, by mass %, one or more of:

Nb: 0.001% to 0.100%;
V: 0.005% to 0.500%;
Mo: 0.001% to 0.500%;
Cu: 0.02% to 1.00%;
Ni: 0.02% to 1.00%;
Cr: 0.02% to 2.00%;
B: 0.0001% to 0.0030%;
Ca: 0.0002% to 0.0100%;
Mg: 0.0002% to 0.0100%;
REM: 0.0002% to 0.0100%; and
Bi: 0.0001% to 0.0200%.

3. The steel sheet according to claim 1, wherein a plating layer is formed on a surface.

4. The steel sheet according to claim 3, wherein the plating layer is a hot-dip galvanized layer.

5. The steel sheet according to claim 3, wherein the plating layer is a hot-dip galvannealed layer.

6. A steel sheet manufacturing method that is a manufacturing method of the steel sheet according to claim 1, comprising:

a heating step of heating a slab or steel piece having the chemical composition according to claim 1;

a hot rolling step of performing multi-pass hot rolling on the slab or the steel piece after the heating step using a plurality of rolling stands to obtain a hot-rolled steel sheet;

a coiling step of coiling the hot-rolled steel sheet; and a heat treatment step of performing a heat treatment on the hot-rolled steel sheet after the coiling step, wherein, in the heating step, a heating temperature is set to 1280° C. or higher and a temperature SRT (° C.) represented by the following formula (1) or higher, in the hot rolling step, when a finish temperature is represented by FT in a unit of ° C., a total rolling reduction in a temperature range of higher than FT+50° C. and FT+150° C. or lower is set to 50% or more, a total rolling reduction in a temperature range of FT to FT+50° C. is set to 40% to 80%, a time necessary for rolling in the temperature range of FT to FT+50° C. is set to 0.5 to 10.0 seconds, two or more passes of rolling are performed in each of the temperature range of higher than FT+50° C. and FT+150° C. or lower and the temperature range of FT to FT+50° C., an average cooling rate in a temperature range of FT to FT+100° C. is set to 6.0° C./sec or faster and 40.0° C./sec or slower, FT is set to equal to or higher than $Ar_3$ that is obtained from the following formula (2), equal to or higher than TR (° C.) that is obtained from the following formula (3) and 1100° C. or lower, water cooling is initiated within 3.0 seconds from completion of finish rolling, an average cooling rate in a temperature range of FT to 750° C. is set to 30° C./sec or faster, the slab or the steel piece is dwelt in a temperature range of 750° C. to 620° C. for 20 seconds or shorter and then cooled to a cooling stop temperature that is 620° C. to 570° C. such that an average cooling rate in a temperature range of the cooling stop temperature reaches 30° C./sec or faster, in the coiling step, the hot-rolled steel sheet is coiled at 570° C. or lower, in the heat treatment step, a maximum attainment temperature Tmax is set to 550° C. or higher and 720° C. or lower, and a tempering parameter Ps is set to 14000 to 18000, $$SRT\ (^\circ\ C.)=1630+90\times\ln([C]\times[Ti]) \quad (1)$$

$$Ar_3\ (^\circ\ C.)=901-325\times[C]+33\times[Si]-92\times[Mn]+287\times[P]+40\times[sol.\ Al] \quad (2)$$

$$TR\ (^\circ\ C.)=800+700\times[Ti]+1000\times[Nb] \quad (3)$$

here, [element symbol] in the formulae (1), (2) and (3) indicates the amount of each element by mass %, and zero is assigned in a case where the element is not contained.

7. The steel sheet manufacturing method according to claim 6, wherein, in the hot rolling step, the water cooling is initiated within 0.3 seconds from completion of the finish rolling, and cooling in which an average cooling rate in a temperature range of FT to FT−40° C. is 100° C./sec or faster is performed.

8. The steel sheet according to claim 2, wherein a plating layer is formed on a surface.

* * * * *